United States Patent [19]

Litz

[11] 4,088,097

[45] May 9, 1978

[54] CRANKCASE-SCAVENGED ENGINE

[76] Inventor: Harold Litz, 2285 N. 7th St., North St. Paul, Minn. 55109

[21] Appl. No.: 712,643

[22] Filed: Aug. 9, 1976

Related U.S. Application Data

[63] Continuation-in-part of Ser. No. 511,489, Oct. 30, 1974, Pat. No. 3,973,532.

[51] Int. Cl.[2] ..... F02B 33/04; F01M 1/04

[52] U.S. Cl. ..... 123/73 AA; 123/196 R; 184/6.5; 308/187

[58] Field of Search ..... 123/73 R, 73 A, 73 AA, 123/196 R; 184/6.5, 6.8, 101; 308/187

[56] References Cited

U.S. PATENT DOCUMENTS

| | | | |
|---|---|---|---|
| 931,976 | 8/1909 | Turner | 123/75 CC |
| 1,584,897 | 5/1926 | Skinner et al. | 184/6.8 |
| 1,610,761 | 12/1926 | Dubrouin | 184/6.5 |
| 2,111,324 | 3/1938 | Linthwaite | 123/73 AA |
| 2,232,170 | 2/1941 | Eynon | 184/6.5 |
| 2,280,296 | 4/1942 | Mantle | 184/6.5 |
| 2,409,057 | 10/1946 | Meinke | 184/6.8 |
| 2,936,748 | 5/1960 | Jensen | 184/6.5 |
| 3,056,638 | 10/1962 | Houde | 184/6.5 |
| 3,156,191 | 11/1964 | Lauch | 308/187 |
| 3,257,997 | 6/1966 | Sheaffer | 123/73 AA |
| 3,628,835 | 12/1971 | Cornish et al. | 308/187 |
| 3,672,172 | 6/1972 | Hammond | 123/75 CC |
| 3,722,967 | 3/1973 | Lewis | 308/187 |

*Primary Examiner*—Charles J. Myhre
*Assistant Examiner*—David D. Reynolds
*Attorney, Agent, or Firm*—Merchant, Gould, Smith, Edell, Welter & Schmidt

[57] ABSTRACT

An internal combustion, reciprocating-piston engine which includes a sealed crankcase for inducting and compressing air or an air-fuel mixture into the engine. The compressed gas is then forced into a holding tank for subsequent induction into the cylinder combustion chamber. This pre-compresses or "supercharges" the fuel mixture before compression by the piston. An enclosed lift tube within the connecting rod is provided for conveying lubricating oil through the crankcase to the cylinder walls.

10 Claims, 16 Drawing Figures

CRANKCASE-SCAVENGED ENGINE

CONTINUATION-IN-PART APPLICATION

The present application is a continuation-in-part of a copending pat. application Ser. No. 511,489, filed Oct. 30, 1974 now U.S. Pat. No. 3,973,532.

BACKGROUND OF THE INVENTION

1. Field of the Invention

An internal combustion engine utilizing a reciprocating piston and a super-charger device for pre-compressing the fuel mixture prior to induction into the combustion chamber.

2. Description of the Prior Art

Internal combustion engines which utilize a reciprocating piston in a cylinder and burn a mixture of fuel and air to produce power have long been known. Such engines are generally used to turn a crankshaft which is contained in a crankcase located adjacent the piston. Internal combustion engines operate by adding fuel to combustion air, drawing the air-fuel mixture into the combustion chamber of the cylinder on the induction stroke of the piston, compressing the fuel mixture during the compression stroke, driving the piston downwardly as the compressed fuel-air mixture is ignited during the power stroke and forcing the spent combustion products out of the combustion chamber during the exhaust stroke. This power cycle is repeated continuously to impart a reciprocating motion to the piston. This reciprocating motion of the piston is transmitted through a connecting rod to a crankshaft.

The power which is delivered by the four-stroke internal combustion engine is directly dependent upon the combustion of the fuel in the combustion chamber. Such factors as the octane of the fuel, the temperature of the fuel and the amount of fuel present in the combustion chamber during ignition of the fuel-air mixture partially determine how much explosive thrust is imparted to the piston by the burning fuel. In conventional engines of this type, the fuel mixture which is drawn into the cylinder on the induction stroke of the piston, generally enters the combustion chamber at atmospheric pressure and temperature. Further, the amount of fuel mixture which is drawn in during the induction stroke is limited by the length of time which is available during which the piston moves from one end of its induction stroke to the other. Thus, the atmospheric temperature of the fuel mixture, the lack of high pressure to help propel the fuel mixture into the combustion chamber on the intake stroke, and the limited amount of time during which the fuel mixture can be inducted all tend to limit the amount, temperature and pressure of the fuel mixture in the combustion chamber during the power stroke. These factors then tend to limit the power output of the engine.

Presently available internal combustion engines generally utilize either an oil pump, wherein oil in pumped to the connecting rod bearings and splashed to the cylinder walls and wrist pin and other moving parts, or a splash system for lubricating the engine cylinders during running of the engine. In the splash type system, the oil is carried in the crankcase where it is splashed up to the cylinder wall to lubricate the moving pistons and other moving parts. Thus, the lubricating oils are exposed to the conditions of heat and pressure which are experienced in the crankcase as the engine is running.

SUMMARY

The present invention is a four stroke internal combustion engine which utilizes a crankcase scavenging device for precompressing and preheating air prior to its induction into the engine combustion chamber. The combustion air is drawn into the crankcase through a one-way valve on the compression and exhaust stroke of the engine. This combustion air also helps cool the interior of the engine. During the induction and power stroke of the engine, the piston compresses this inducted air in the crankcase and forces it into a holding chamber. The compressed air in the holding chamber is subsequently inducted into the combustion chamber of the engine cylinder. Because the combustion air has been precompressed in the crankcase, it moves into the combustion chamber at a more rapid rate and at a higher pressure allowing a greater amount of combustion air and fuel mixture to be present in the combustion chamber. This provides more fuel for the ignition process and provides more force to the piston on the power stroke. As a result, more power is delivered than if the crankcase scavenging feature were not present.

Because the crankcase is utilized as a compression chamber, the present invention provides a flywheel on each side of the connecting rod. These flywheels are also part of the crankshaft and will hereinafter be referred to as the "crankshafts." The crankcase has the same contour as the crankshaft to provide a sealed periphery for the crankcase compression chamber. In addition, the bottom surface of the piston is contoured to more closely fit against the crankshaft thereby decreasing the volume of the crankcase compression chamber and increasing the pressure which is imparted to the inducted air. An oil distribution system is provided for lubricating the piston. This system incorporates an enclosed lift tube or tubes extending along the connecting rod which is attached between the piston and the crankshaft. The life tube allows the oil to be distributed through a channel system within the piston to the periphery of the piston.

One-way valves are used to regulate the induction and exhaust of combustion gas into and out of the crankcase compression chamber. This use of simple valve devices reduces the likelihood of mechanical failure and simplifies the design. Further, a holding tank is utilized for receiving the compressed combustion gas prior to its induction into the combustion chamber. This provides a ready reserve of compressed combustion air for instantaneous induction into the combustion chamber. A throttle valve is provided between the holding chamber and the combustion chamber to provide quick control to the running of the engine by controlling the flow of combustible mixture of fuel and air or oxygen from the holding chamber to the combustion chamber.

In an alternative preferred embodiment, a two cycle embodiment of the invention is specifically described. This embodiment utilizes the features specified in the preferred embodiment to accomplish precompression of the combustion gases. In the two cycle embodiment, the precompression occurs in the crankcase with the gases being moved to the combustion chamber through gas intake means. The gas intake means comprise gas passageways located in the engine cylinder and gas ports contained in the engine piston. The alternative preferred embodiment also includes oil distribution means for carrying lubricating oil from the main bearing to the connecting rod. These oil distribution means include directional cavity means contained within the crankshaft which direct the lubricating oil through a communicating channel within the crankshaft to the connecting rod. The directional cavity means include a side surface and an inclined surface which provide a funnel communicating with the communicating channel. Oil flows along the outer race of the main bearing to the end portion of the outer race where it is distributed to the cavity formed between the side surface and the inclined surface and thence through the communicating channel. This flow of oil occurrs under centrifugal forces directed as the crankshaft rotates.

REQUEST FOR USE OF INFORMAL DRAWINGS FOR PURPOSES OF EXAMINATION

Figure 1:
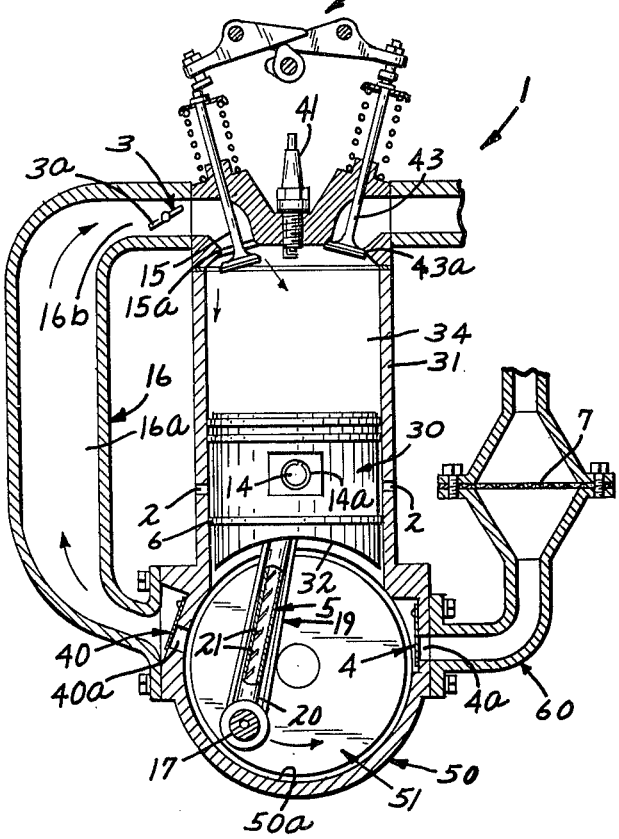
FIG. 1 is a side sectional view of the engine showing the piston near the end of the induction stroke.
Figure 2:
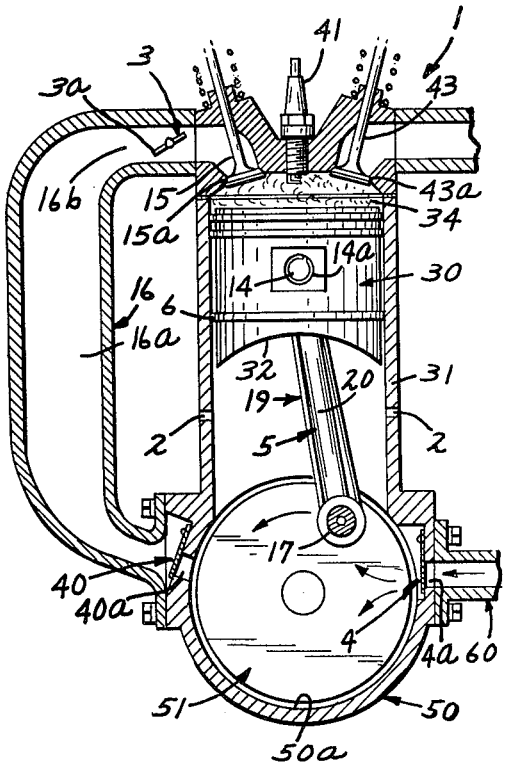
FIG. 2 is a side sectional view of the engine showing the piston during the compression stroke.

Pursuant to Rule 85, the Applicant respectfully requests that the informal drawings of FIGS. 1–10 submitted with application Ser. No. 511,489, be accepted in informal form for purposes of examination only. The original drawings are contained in application Ser. No. 511,489, which will not be abandoned. Formal drawings are presently being prepared which will be exact duplicates of the drawing copies for FIGS. 1–10 included herewith.

DETAILED DESCRIPTION OF THE PREFERRED EMBODIMENT

FIRST PREFERRED EMBODIMENT

Referring to FIGS. 1–7, wherein like numerals refer to like structural elements, the present invention comprises a reciprocating piston 30 which moves in a cylinder 31 to drive a crankshaft 51. A sealed crankcase 50 is utilized in combination with a holding tank 16 to provide recompression means to supercharge the engine 1. Lubricating means 5 are provided in a connecting rod 19 as a preferred embodiment for lubricating the wrist pin and peripheral surface of piston 30. Throttle valve apparatus 3 is provided for purposes of regulating the flow of supercharged gas from the holding tank 16 to an engine combustion chamber 34.

In the preferred embodiment of the present invention, the crankcase scavenged engine apparatus 1 provides power to the crankshaft 51 by movement of piston 30 in a four-stroke cycle. Piston 30 is connected to crankshaft 51 by means of a connecting rod 19 connected to crankshaft 51 by means of bearings 17. FIG. 1 shows the induction stroke, FIG. 2 the compression stroke, FIG. 3 the power stroke and FIG. 4 the exhaust stroke. While FIGS. 1–4 show a single piston apparatus, the present invention may pertain to an engine having any number of such pistons, each having the design described herein and each interconnected with the other by means of the crankshaft for synchronized operation.

To increase the power which is delivered by the engine on the power stroke, supercharging or "scavenging" apparatus are provided to precompress the combustion gas prior to its induction into the combustion chamber 34 (on the induction stroke). These scavenging means include a sealed crankcase 50 associated with each of pistons 30. In addition, holding tank 16 encloses a holding chamber **16*a*** which is utilized for purposes of periodically and cyclically storing the compressed gas prior to its induction, as will be described later.

Referring to FIG. 1, sealed crankcase 50 is generally cylinderical, having the same interior contour as that of crankshaft 51. The top portion of sealed crankcase 50 communicates with the cylinder 31 and is partially enclosed by the piston 30. The crankshaft 51 extends laterally along the crankcase 50 to the ends of the crankcase 50 where sealing and bearing support means are provided for forming a sealed compression chamber bounded by the walls of crankcase 50 and piston 30. Thus, as the piston 30 reciprocates in cylinder 31, the volume of the chamber formed beneath piston 30 by the sealed crankcase 50 varies.

It is the purpose of sealed crankcase 50 to provide a compression chamber for precompressing the combustion air prior to its induction into cylinder combustion chamber 34. To provide means for inducting and discharging air from sealed crankcase 50, pressure operated one-way valves 4 and 40 are utilized in combination with an air intake manifold 60 and holding tank 16. Referring to FIG. 1, air which is to be utilized in the combustion process within the engine 1 enters the engine through air inlet manifold 60. It passes from air inlet manifold 60 into sealed crankcase 50 through a one-way crankcase intake valve 4 on the compression stroke of piston 30. The gas then undergoes compression in the crankcase 50 on the power stroke of the piston 30. As this gas is compressed in the crankcase 50, it is expelled out crankcase exhaust valve 40 into holding tank 16. This induction and compression cycle is repeated on the exhaust and induction stroke of piston 30.

Figure 3:
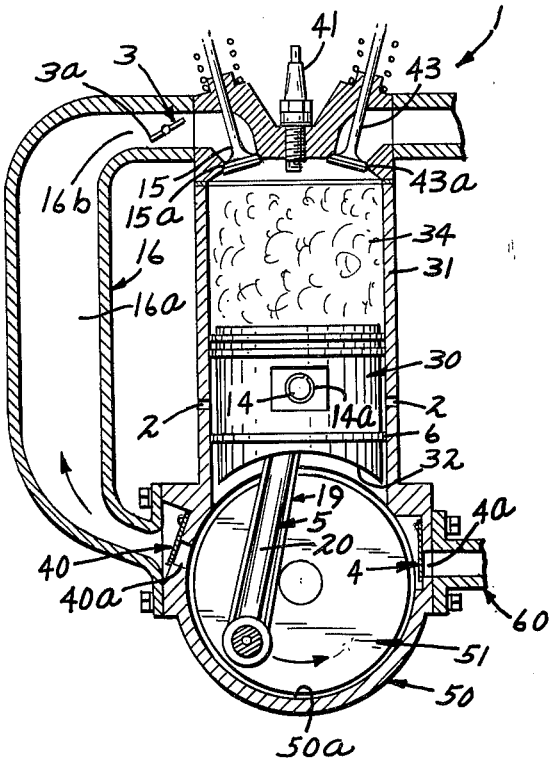
FIG. 3 is a side sectional view of the engine showing the piston during the power stroke.
Figure 4:
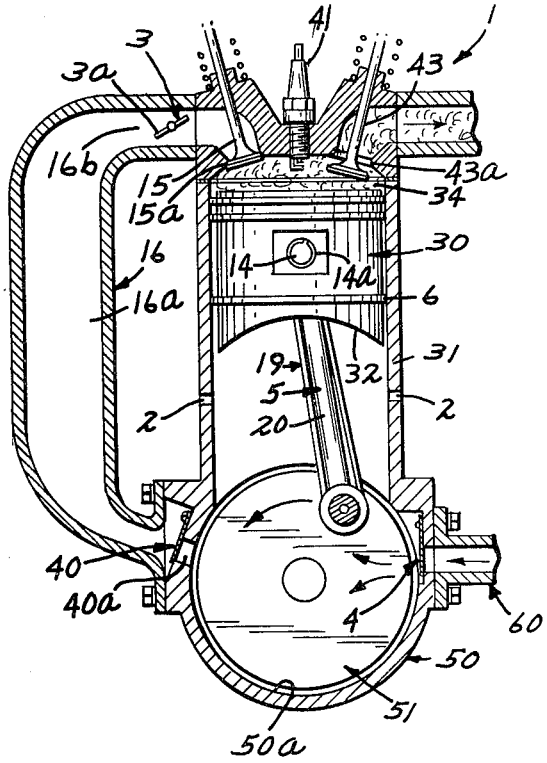
FIG. 4 is a side sectional view of the engine showing the piston on its exhaust stroke.

The induction and compression of the combustion air which is drawn into sealed crankcase 50 can be described in detail as follows. On the compression stroke of piston 30 (FIG. 2), crankcase intake valve 4 is automatically opened by the pressure drop in crankcase 50 while crankcase exhaust valve 40 is automatically closed. As a result, as piston 30 moves upwardly on its compression stroke, a vacuum is created beneath the piston 30 and air is drawn in through air intake manifold 60 and crankcase intake valve 4. When piston 30 reaches the end of its compression stroke, it begins to move downwardly on the power stroke (FIG. 3). This causes an increase in the pressure in crankcase 50 which automatically closes the one-way crankcase intake valve 4 and opens the one-way crankcase exhaust valve 40. Thus, the gas which was drawn into crankcase 50 on the compression stroke of piston 30, is now pressurized and expelled into holding tank 16. On the exhaust stroke of piston 30 (FIG. 4) a vacuum is again drawn in crankcase 50 as the piston moves upwardly in cylinder 31. Again, the vacuum force in crankcase 50 automatically opens the one-way crankcase intake valve 4 and closes the one-way crankcase exhaust valve 40. Air is drawn into crankcase 50 through manifold 60 from the carburetor (not shown). When the piston 30 reaches the top of its exhaust stroke, it again changes direction and begins moving downwardly. This opens the crankcase exhaust valve 40 and closes the crankcase intake valve 4. As the piston moves downwardly on the induction stroke (FIG. 1), the inducted air is pressurized and forced from crankcase 50 into holding tank 16, with some of the air in holding tank 16 simultaneously moving into combustion chamber 34. Thus, it can be seen that for each power stroke of engine 1, there are two compression strokes for the air which is inducted into crankcase 50. This results in an accumulation of pressurized combustion air in holding tank 16 on the power stroke of piston 30 and a forced induction of compressed air from holding tank 16 into combustion chamber 34 on the induction stroke of engine 1.

It is the purpose of this supercharging or scavenging apparatus to provide a supply of pressurized combustion air in holding tank 16 and to forcibly inject the air into combustion chamber 34. The store of gas in chamber 16 is subsequently forced into the combustion chamber 34 at a pressure above atmospheric pressure by means which will be described in detail later. Unlike conventional internal combustion engines, because the combustion air is first pressurized before its forced induction into combustion chamber 34, it has a higher temperature and has a higher density of fuel-air mixture per unit volume. In addition, because there is a positive pressure buildup between the holding tank 16 and combustion chamber 34, in the limited time during which the combustion chamber intake valve 15 is open, a larger amount of combustion gas can be drawn into the combustion chamber 34. As a result, a more advantageous burning of the fuel and air mixture occurs on the power stroke of engine 1 and greater power output is achieved.

As described above, the holding tank 16 is utilized to store the gas which is moved from crankcase 50 on the induction and power strokes of piston 30. If two of engines 1 were placed in an opposed position utilizing the same crankcase combustion chamber 50, the holding tank 16 would be a mere conduit or manifold and not a true holding tank. This results because the piston 30 in each of the opposed engines would be at the same location in its cylinder at the same time but the engine would be at different strokes. In one of the cylinders, the piston would be on the induction stroke while in the opposite cylinder the piston would be on the power stroke. Similarly, when one of the opposed cylinders is in the exhaust stroke, the opposed cylinder would be in the compression stroke. In a situation where several pairs of the engine 1 are positioned on an in-line position, the pistons would again be at relatively the same position in each cylinder, but would be at opposite strokes. When one piston was in the exhaust stroke, the other piston would be in the compression stroke and when one piston was in the induction stroke the other piston would be in the power stroke. In the case of these multiple arrangements of engine 1, be it either in an in-line or an opposed arrangement, the combustion air which is compressed in the crankcase compression chamber 50 is not stored in the chamber 16 during alternate strokes, but is continually moved into one of the pairs of cylinders.

The present invention can be utilized with various means and methods for adding fuel to the combustion air and for carbureting the engine. In the preferred embodiment shown in FIG. 1, the fuel is added to the combustion air at a point upstream of the manifold 60 (not shown). Thus, the air which passes through air intake manifold 60 is a mixture of air and fuel. An atomizing screen 7 has been provided in air intake manifold 60 (FIG. 1) to finely atomize the fuel for mixture with the combustion air. Because the fuel can be added to the combustion air at any point, either before it enters crankcase 50, in holding tank 16 or in combustion chamber 34, whenever reference is made to "combustion air," the term may also refer to a mixture of fuel and air.

The combustion air contained in holding tank 16 enters combustion chamber 34 on the induction stroke of engine 1 (FIG. 1). Two valve means are provided between holding tank 16 and combustion chamber 34 to regulate the flow of the compressed gas into combustion chamber 34. A standard combustion chamber intake valve 15 is provided which operates off a rocker arm mechanism 42. This intake valve mechanism is similar to that found on conventional internal combustion engines wherein the timing of the valve opening is synchronized with a firing cycle. The second valve means is a throttle valve 3 which is located between holding tank 16 and the combustion chamber intake valve port **15*a*. It is the purpose of throttle valve 3 to regulate the flow of compressed combustion air from holding tank 16 into combustion chamber 34 when the automatic intake valve 15 is open. Since the throttle valve 3 is located very near the intake valve 15, there is very little residual gas which enters the combustion chamber 34 once the throttle 3 has been closed. This provides instantaneous control of the combustion air which enters the combustion chamber 34 and thus provides instantaneous control for the speed and operation of the engine 1**.

As was noted earlier, crankcase intake valve 4 and exhaust valve 40 are each one-way valves which restrict intake valve port **4*a* and exhaust valve port 40*a*, respectively. They may be reed valves or other one-way valves. The use of a simple pressure controlled one-way valve in these two locations allows the valve to open and close automatically in response to pressure changes in crankcase 50. Thus, the operation of valves 4 and 40 are always synchronized with the motion of piston 30 and additional timing mechanisms are not necessary to control these valves. In addition, the simplicity of valves 4 and 40** reduce the likelihood of breakdown or necessary repair.

The combustion chamber intake and exhaust valves 15 and 43 each restrict an intake port 15*a*, and exhaust port 43*a*, respectively. These valves and ports may have various designs depending on the exact nature of the cylinder design. A standard rocker arm assembly 42 can be utilized for controlling the opening and closing of these valves. In the embodiment shown in FIG. 1, a spark plug 41 is utilized for igniting the gas mixture in combustion chamber 34 to produce the power stroke for the engine. Other means of ignition may also be utilized where appropriate.

Since the crankcase 50 is a sealed crankcase which is utilized as a compression chamber for supercharging the combustion air, the present invention utilizes various devices for producing a very effective crankcase compression chamber 50. In particular, referring to FIG. 1, the interior crankcase surface 50*a* has been contoured to closely fit the crankshaft 51. In addition, crankshaft 51 is generally cylindrical and extends laterally to the end (not shown) of the sealed crankcase portion 50. As a result, the amount of open space in the crankcase 50 is reduced so that the motion of piston 30 produces a higher compression in the crankcase chamber 50. In addition, the bottom surface 32 of piston 30 is shaped to match the contour of crankshaft 51 in those portions of the piston where it is adjacent to crankshaft 51. The connecting rod 19 attaches to piston 30 by means of a wrist pin 14 (see FIG. 6). An indentation (not shown) is provided along the centerline of piston 30 so that the connecting rod 19 can move freely as the piston 30 reciprocates. The volume of the indentation in piston 30 for connecting rod 19 has been minimized to again provide a smaller volume to increase the pressure which is achieved when piston 30 moves downwardly to compress the gas in crankcase 50. This can be achieved by utilizing volume takeup blocks, each designated by the numeral 31*a* within the cylinder 31 under piston 30 which partially occupies the indentation within piston 30 in which the connecting rod oscillates. This reduces the open volume of the indentation and thus the volume of the piston is reduced, reducing the volume within crankcase 50. As a result, the combustion air drawn into the crankcase 50 is compressed to a higher pressure by movement of the piston 30.

Figure 5:
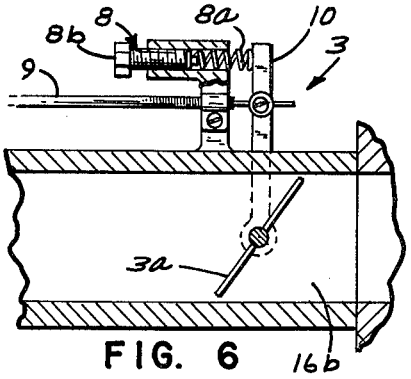
FIG. 5 is a detailed sectional view showing the throttle assembly.

FIG. 5 shows the throttle valve 3 in detail. The valve 3 has a valve plate 3*a* which is located within passageway 16*b* which communicates between holding tank 16 and intake valve port 15*a*. A throttle cable 9 attached to a throttle arm 10 to vary the angle at which throttle valve plate 3*a* is positioned to thereby vary the open space through which combustion gas can flow from holding tank 16 into intake valve 15. Throttle arm 10 and cable 9 are located in the outside of passageway structure 16*b*. An idle-adjustment screw mechanism 8 is provided for holding the throttle valve 3 in a partially open position when the engine is idling. The idle screw mechanism 8 consists of a spring 8*a* which bears against throttle arm 10 and a set screw 8*b*. Spring 8*a* keeps throttle arm 10 in a biased, partially open idle position when no force is exerted on throttle arm 10. Set screw 8*b* positions biasing spring 8*a* at a selected, partially open idle position. To completely close the throttle plate 3*a*, a positive push or pull force is exerted on the push-pull throttle cable 10 to overcome the bias of spring 8*a*, thus moving the plate 3*a* to a totally closed position.

Unlike most engines, wherein throttling occurs at or near the carburetor location, in the present invention the throttle valve 3 is located very near the intake valve port 15*a* for combustion chamber 34. This allows instantaneous control of the running of engine 1. The close proximity of throttle valve 3 to combustion chamber 34 eliminates the presence of residual gases which would have to be burned following activation of the throttle valve before the engine would actually respond to the actuation of the throttle valve.

To lubricate the peripheral surface of piston 30 in cylinder 31, the present invention provides alternative lubrication means. In one embodiment shown in FIG. 1, oil holes 2 are provided in the wall of cylinder 31 to be utilized in combination with an oil supply means (not shown) to supply oil directly to the interior surface of cylinder 31 at the main points of wear. There may be any number of holes 2 for this purpose. When oil holes 2 are utilized, only one oil lift tube 20, to be described in detail later, would be necessary to lubricate the wrist pin 14 of piston 30. The present invention may also utilize lubrication means wherein oil is added to the gas to lubricate the interior walls of the cylinder 31 and the wrist pin 14. This lubrication would occur when the oil entered valve 4 as a vapor and was conveyed to the interior surfaces of the engine 1. However, this method of lubricating the engine 1 would be more costly because of the amount of oil which would be necessary and because of the difficulties encountered in mixing oil with fuel.

Figure 7:
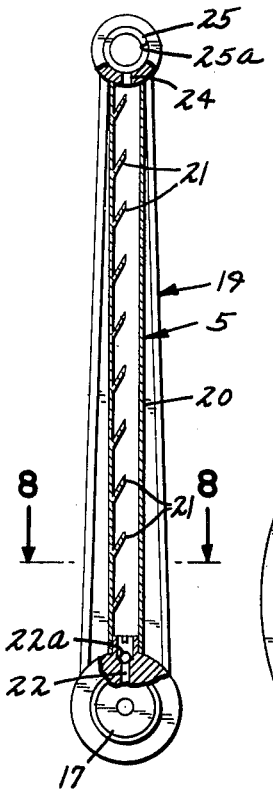
FIG. 7 is a detailed side view of the connecting rod showing the oiling lift tubes in cross section.
Figure 6:
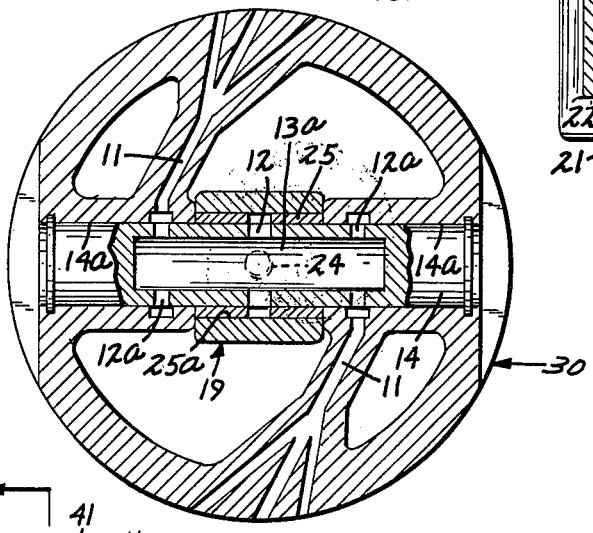
FIG. 6 is a top sectional view of the piston showing the lubricating channels.
Figure 8:
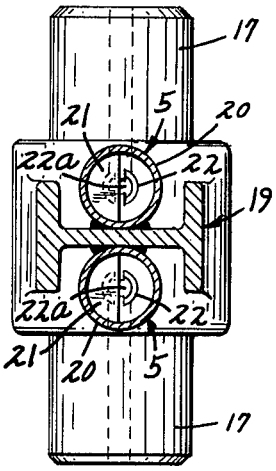
FIG. 8 is a top sectional view of the connecting rod of FIG. 7 taken along the line 8—8.
Figure 9:
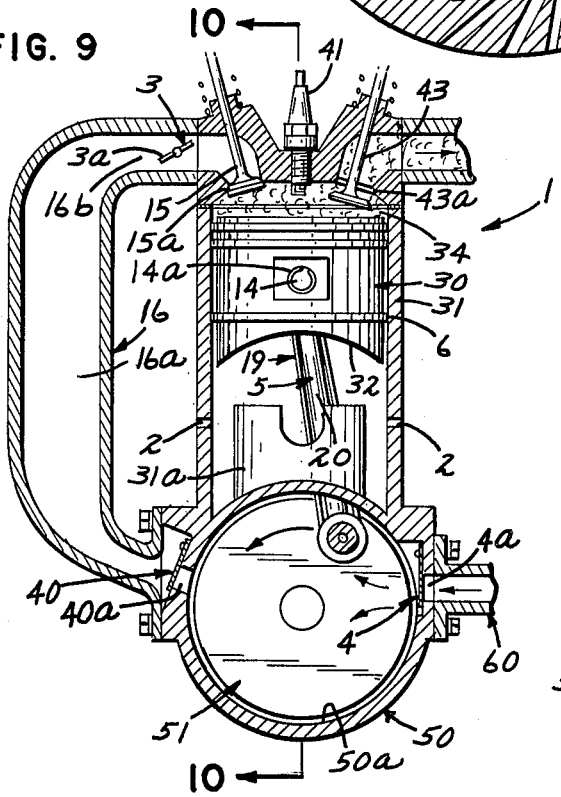
FIG. 9 is a side elevational view of the engine showing the volume take-up block.
Figure 10:
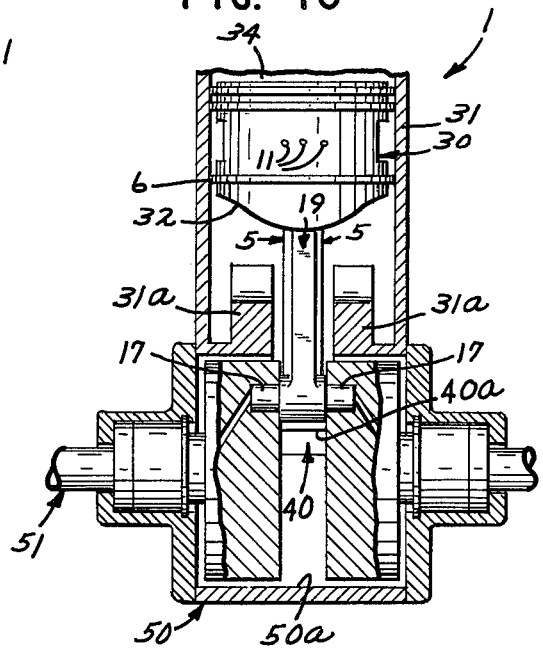
FIG. 10 is a front section view of the engine showing the volume take-up blocks and connection of the connecting rod to crankshaft.

In the embodiment shown in FIGS. 6 and 7, lubricating means 5 are provided for supplying oil from the crankshaft 51 to the wrist pin 14 and piston 30. In conventional internal combustion engines where the crankcase is not utilized as a compression chamber, oil is splashed from the crankshaft up to the interior walls of the cylinder and wrist pin. In addition, in conventional engines, oil supply means are provided to lubricate the rocker arm assembly of the engine (such as rocker arm assembly 42) and these means are typically connected with the crankcase lubrication means. In the present invention, the crankcase 50 must be utilized as a compression chamber and thus it is preferrable that the oil be carried to cylinder 30 from crankshaft 51 through the internal conduit system so that the oil is not subject to evaporation and heat in crankcase 50. Such an internal conduit system is a part of lubricating means 5. A separate oiling system (not shown) is used for rocker arms 42. In addition, a separate chamber (not shown) is used for lubricating gears and pumps and to pump oil into the crankshaft for lubricating the crankshaft bearings.

Referring to FIG. 7, the present lubricating means 5 utilize two oil lift tubes, each designated by the numeral 20, attached to the exterior surface of connecting rod 19. Oil is carried to the connecting rod 19 from a source of oil (not shown) through crankshaft 51 and along connecting rod bearing 17. From connecting rod bearing 17, the oil flows through a lower oil port 22 in connecting rod 19 and up through the lift tube 20. The oil lift tubes 20 would have a one-way valve at their lower port 22, as will be described in detail later.

In the embodiment shown in FIG. 1, the connecting rod 19 is attached to piston 30 by means of a wrist pin 14 which is supported by bearing 25 located in opening 25*a* of the connecting rod 19. The wrist pin 14 extends through an opening 14*a* in piston 30 to interconnect the connecting rod 19 to the piston 30. In the lubricating system 5 of FIG. 7, the oil passes out of lift tubes 20 through an upper oil port 24 to the area surrounding wrist pin 14. The oil then passes through a hole 12 in wrist pin 14 to an interior channel 13*a* within wrist pin 14. From channel 13*a*, the oil flows through two holes 12*a* located at either end of channel 13*a*. The holes 12*a* positioned to communicate with oil passageway means 11 contained in piston 30. As is shown in FIG. 6, the oil passageways 11 in piston 30 extend from the wrist pin opening 14*a* to the outer periphery of the piston 30. In this way, the oil flows from the wrist pin 14 through oil channels 11 to the periphery of the piston 30 for lubricating that area of the piston.

The oil which is carried to the periphery of piston 30, tends naturely to flow downwardly along the exterior surface of piston 30. A lower oil ring 6 positioned at the bottom portion of piston 30, is utilized to keep the oil from flowing past this point to the area beneath the piston 30 and into crankcase 50. Thus, the oil which is carried to the piston periphery through the oil means 5 is kept from entering the crankcase 51 by the lower oil ring 6 on piston 30. As a result, very little of the lubricating oil enters the crankcase 50 and what does enter is evaporated with the gas or air and is burned. In certain instances, a lower oil ring would not be necessary.

To propel the oil from the lower oil channel 22 to the upper oil channel 24 in connecting rod 19, it may be necessary to utilize cascade riffles 21 positioned in lift tube 20. It is the purpose of riffles 21 to sequentially splash the oil up the interior of lift tube 20 by a cascading action as the connecting rod 19 continually reciprocates. In this way, an effective lubricating means is provided for a crankcase scavenged internal combustion engine which utilizes the crankcase as a compression chamber for precompressing the combustion gas.

The oil which is propelled through lubricating means 5 is supplied by pressurized means which pump oil from an oil source (not shown) into the crankshaft 51. This oil enters the lift tubes 20 of connecting rod 19 through an opening 22 adjacent to the bearing (not shown) which supports the connecting rod 19 on the crankshaft 51. A one-way valve 22*a* is positioned in opening 22 to allow oil to flow up into lift tubes 20 and prevent oil from flowing out of lift tubes 20 through opening 22. The one-way valve 22*a* operates automatically as the connecting rod 19 moves up and down. Because of the reciprocating movement of connecting rod 19, a centrifugal force is produced which automatically opens and closes the one-way valve 22*a*. In operation, the combined effect of one-way valve 22*a* and oil lift tube 20 provides means for filling the oil lift tubes 20 with oil once the engine is running. A combination of pressure forces and capillary forces then tends to move the oil through the various passageways in connecting rod 19 and piston 30 to move the oil from the lift tubes 20 to the periphery of piston 30. Because the various channels and passageways are relatively small in dimension, and because the forces which tend to move the oil up the lift tube 20 and through the various passage ways are small the amount of oil which flows up to the periphery of piston 30 is relatively small. Consequently, the oil which finds its way to the periphery of piston 30 can be kept in that location by the lower ring 6 on piston 30 and the small amount of oil which enters the crankcase would be evaporated and burned up.

The present invention produces a high efficiency operation because of its supercharging apparatus. In addition, the particular throttle mechanism provides instantaneous control of the engine. An improved lubricating means has been provided for lubricating the exterior surface of the engine piston. The engine could find particular usefulness in airplane motors, motorcycles and the like. The individual piston-cylinder apparatus 1 may be combined in various combinations. For instance, the total engine may consist of pistons which are in opposed pairs (i.e. 4, 6, 8, etc. in-line cylinders) or vertical twins.

The crankshaft 51 is balanced, wherever necessary by boring holes into the crankshaft 51 in a particular pattern which properly balances the crankshaft. Since it is important that the open volume of the crankcase chamber 50 be minimized to increase the pressure which is produced on the down stroke of piston 30, the balancing holes (not shown) which are placed in crankshaft 51 must be filled with a lightweight material or sealed (not shown) to eliminate the open volume of such holes or openings.

ALTERNATIVE PREFERRED EMBODIMENT

Referring to FIGS. 1–16, wherein like numerals refer to like structural elements, an alternative embodiment of the present invention comprises an engine 101 which operates on two cycles and which utilizes oil distribution means 190 to move lubricating oil under centrifugal force from a main bearing 193 to connecting rod 119. Engine 101 encludes a reciprocating piston 130 which moves in a cylinder 131 to drive a crankshaft 151. A sealed crankcase 150 is utilized to provide precompression means to supercharge the engine 101. Lubricating means 105 are provided in a connecting rod 119 as a preferred embodiment for lubricating the wrist pin and peripheral surface of piston 130. Various throttle apparatus may be provided as has been described elsewhere in this application for regulating the flow of supercharged gas.

Figure 15:
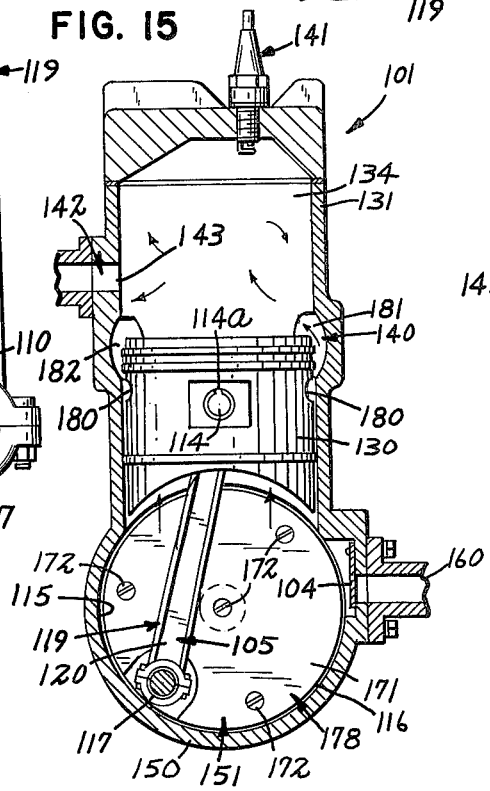
FIG. 15 is a side sectional view of the alternative embodiment engine showing the piston near the bottom of its stroke.
Figure 16:
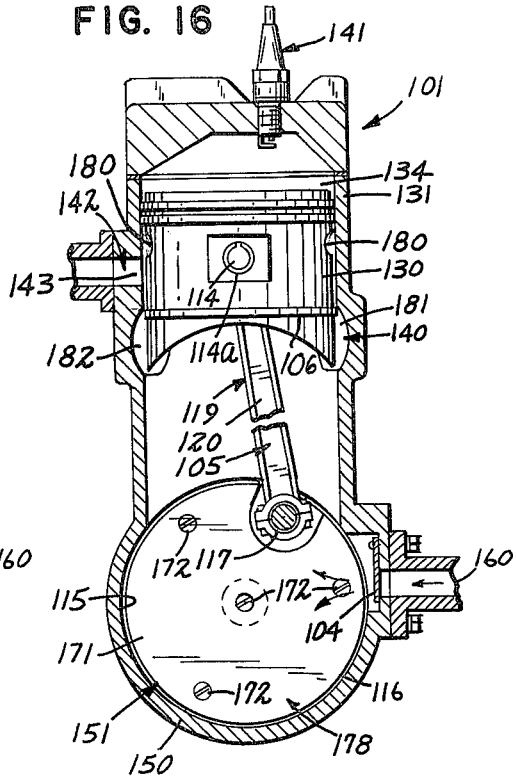
FIG. 16 is a side sectional view of the alternative embodiment engine showing the piston near its top stroke.

The crankcase scavenged engine apparatus 101 provides power to the crankshaft 151 by movement of piston 130 in a two stroke cycle. Piston 130 is connected to crankshaft 151 by means of a connecting rod 119 connected to crankshaft 151 by means of bearings 117. FIG. 15 shows engine 101 with piston 130 near the bottom of its cycle wherein the gas beneath the piston is being supercharged by pressure. FIG. 16 shows piston 130 near the top of its cycle wherein the gas above the piston is being pressurized for ignition and additional combustion gas is being inducted into the crankcase chamber 178 through an intake valve 104. While FIGS. 11–16 specifically depict a single two cycle piston apparatus, the present invention, including the alternative embodiment, may pertain to an engine having any number of such pistons, each having a design similar to that described herein.

It is the purpose of the alternative embodiment to provide improved lubrication means for any type of reciproating engine apparatus and to also provide supercharging capabilities for an internal combustion engine. Referring to FIGS. 15–16, sealed crankcase 150 is generally cylindrical, defining a crankcase chamber 178 having the same interior contour as that of crankshaft 151. The top portion of sealed crankcase 150 communicates with the cylinder 131 and is partially enclosed by the piston 130. The crankshaft 151 extends laterally along the crankcase 150 to the ends of the crankcase 150 where sealing and bearing support means are provided for forming a sealed compression chamber bounded by the walls of crankcase 150, and portions of cylinder 131 and the bottom of piston 130. Thus, as the piston 130 reciprocates in cylinder 131, the volume of the chamber formed beneath piston 130 varies.

It is one purpose of sealed crankcase chamber 178 to provide chamber for precompressing combustion air or air-fuel mixture prior to its induction into the combustion chamber 134. To provide means for inducting and discharging air from sealed crankcase 150, a pressure operated one-way valve 104 and gas intake means 140 are utilized, in combination with air intake manifold 160 through which the combustion air or air/fuel mixture may be drawn.

Air which is to be utilized in the combustion process within the engine 101 enters the engine through air inlet manifold 160. It passes from air inlet manifold 160 into sealed crankcase 150 through a one-way crankcase intake valve 104 on the upward compression stroke of piston 130. The gas then undergoes compression in the crankcase 150 on the downward power stroke of the piston 130. As this gas is compressed in the crankcase 150, exhausting of gases from combustion chamber 134 through gas exhaust means 142 will also take place as is well known in the art of the two cycle engine. This induction and compression cycle is repeated for successive power strokes of the engine.

Gas intake means 140 comprise a first gas passageway 181 which is formed in the walls of cylinder 131, and a second gas passageway 182 which is located opposite the first passageway. Gas passageway 181 and 182 correspond in vertical positioning with two gas ports, each designated by the numeral 180, in the walls of piston 130. Gas ports 180 provide a communication through the interior of piston 130 into crankcase chamber 178. As is well known in the art of two cycle internal combustion engines, as piston 130 moves up and down within cylinder 131, gas ports 180 are intermittently in communication with passageways 181 and 182 to provide for intermittent communication between crankcase chamber 178 and combustion chamber 134. As a result, as piston 130 moves upwardly it will compress the gas ahead of it in the combustion chamber 134 while drawing combustion gas into crankcase chamber 178 through one-way valve 104. After ignition means 141, such as a sparkplug, has ignited the compressed gas, the piston 130 moves downwardly. When the top of piston 130 is below an exhaust port 143, combustion products may be vented out exhaust port 143. Simultaneously, the movement of piston 130 downwardly precompresses the gas which has been drawn into crankcase chamber 178 which is trapped there by the closed position of one-way valve 104. When piston 130 begins moving upwardly, and when gas ports 180 and passageways 181/182 are alined, the precompressed gases within crankcase chamber 178 are vented into combustion chamber 134.

The Applicant has found that the movement of the compressed gas from crankcase chamber 178 through passageways 181/182 is so rapid that little exhaust occurs through exhaust port 143 during this part of the cycle. As is well known in the engine art, various contours to the top of piston 130 may also be utilized to interrupt and retard the outward flow of the combustion gas through the exhaust port during the up cycle of the piston. Such contours to the piston are not specifically shown in the drawings since they are well known in the art. As piston 130 moves upwardly, the combustion gas which has been precompressed in crankcase chamber 178 on the down stroke of the piston is further compressed by the up stroke. Thus, since the gas which flows into the combustion chamber has been precompressed, the compression achieved by the up stroke of piston 130 adds additional energy to the gas prior to its ignition. This increase is energization of the gas through pressurization results in a more efficient and higher powered engine.

Figure 11:
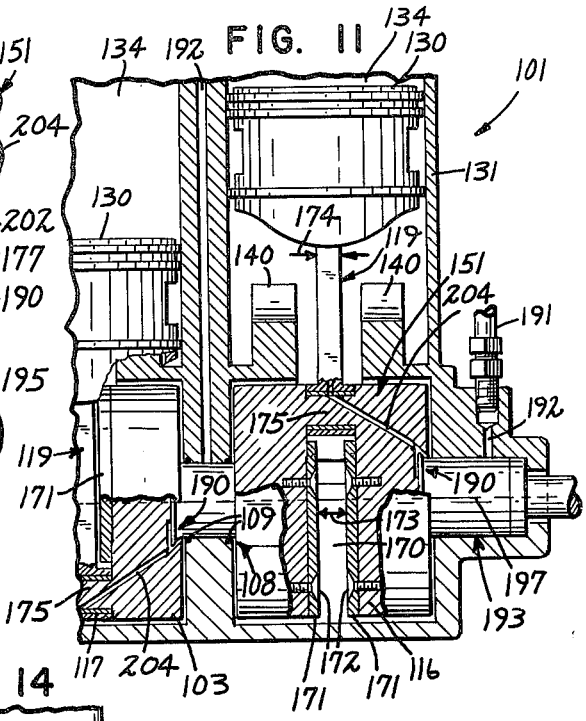
FIG. 11 is a front section view of an alternative engine embodiment showing the compensation plates and the oil distribution means.
Figure 13:
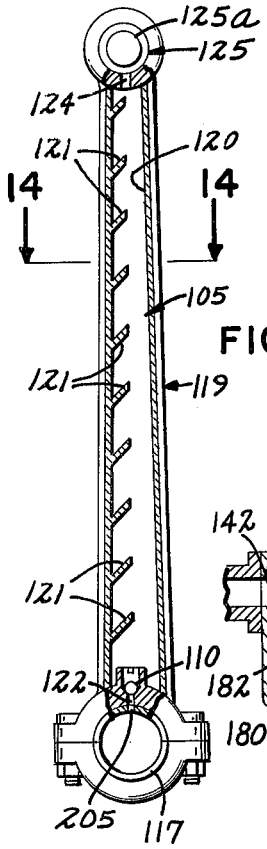
FIG. 13 is a detailed side view of the connecting rod used in the alternative embodiment.
Figure 14:
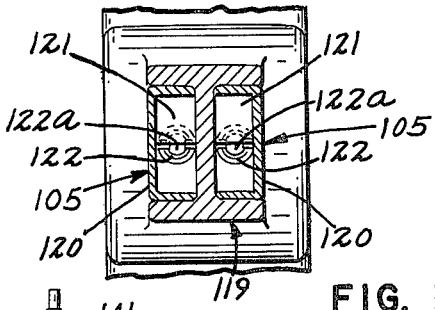
FIG. 14 is a top sectional view of the connecting rod of FIG. 13 taken along the line 14—14.

Various oil rings such as oil ring 106 shown in FIG. 16 may be utilized with piston 130 to reduce the leakage of gas and oil past the piston 130. When two or more cylinders are interconnected, sealing means 108 may be utilized to isolate the individual crankcase chambers 178. This may be necessary since pressure is built up and evacuated within crankcase chambers at opposite times on multiple cylinder engines. As is shown in FIG. 11, various gaskets 109 may be utilized to surround the main bearings 193 where they adjoin crankcase chambers 178. This will reduce the flow of gas between the adjoining crankcase chambers.

While reference has been made to the induction of a fuel-air mixture through air intake manifold 160 directly into crankcase chamber 178, various fuel injection methods different from this may also be utilized to add fuel to the combustion gases prior to ignition by ignition means 141. It is not necessary that the fuel be mixed with the air as it enters the intake manifold. The fuel may be added after the air has been inducted into the combustion chamber 134. Similarly, gas exhaust means 142 may incorporate various exhaust designs. In the embodiment shown in the drawings, an exhaust port 143 is provided for exhausting gases. Various valves and other apparatus may be utilized at this point.

As has been noted in other parts of this application, in order to reduce the volume which is contained within crankcase chamber 178 and beneath piston 130, the bottom surface 132 of piston 130 is contoured to match the exterior surface of crankshaft 151 where the two components meet. In addition, volume takeblocks 140, shown in FIG. 11, are utilized to fit within the interior opening of piston 130 to reduce the volume of air therein. Therefore, a greater compression occurs to the gas beneath the piston. To further reduce the volume which is open within crankcase chamber 178, compensating plates 171 are affixed to the first and second sides of crankshaft 151, designated by the numerals 103 and 116, respectively.

It is the purpose of compensating plates 171 to reduce the open volume occuring between the first and second sides of the crankshaft. If a crankshaft is machined from a single piece of material, sufficient width of the opening between the first and second crankshaft sides must be provided to insert therein a bearing 117 which attaches the bottom end of connecting rod 119 to a connecting rod journal 175 which adjoins the two sides of the crankshaft. Because this diameter is larger than the actual diameter of connecting rod 119 (indicated by the numeral 174), this volume is reduced by inserting the compensating plates 171. These may be attached to the sides of crankshaft 151 by means of screws 172 or other suitable means. As a result, the diameter 173 between compensating plates 171 is slightly larger than the exterior diameter 174 of the connecting rod. This reduces the volume of open space within the crankcase chamber 186.

To lubricate the peripheral surface of piston 130, the present invention provides alternative lubrication means as have been alluded to earlier. In the engine 101 shown in FIGS. 11–16, oil may be added to the gas to lubricate the interior walls of the cylinder 131 and a wrist pin 114. Also, various holes may be provided in the cylinder walls to provide direct lubrication. However, these methods of lubricating the engine 101 would be more costly because of the amount of oil which would be necessary and because of the difficulties encountered in mixing the oil with the fuel. Further, this type of oiling typically results in a large amount of oil being dropped into the crankshaft 150. For the type of engine described in this invention, wherein precompression is desired within the crankcase 150, it is undesirable that large amounts of residual oil be contained in the crankcase 150.

To improve the oiling capabilities for engine 101, lubricating means 105 are provided for supplying oil from the crankshaft 151 to the wrist pin 114 and piston 130. In conventional internal combustion engines where the crankcase is not utilized as a compression chamber, oil, is splashed from the crankshaft up to the interior walls of the cylinder and wrist pin. In the present invention, the crankcase 150 must be utilized as a compression chamber and thus it is preferable that the oil be carried to the cylinder 130 from crankshaft 151 through an internal conduit system so that the oil is not subject to evaporation and heat in crankcase 150. Such an internal conduit system is a part of lubricating means 105.

The present lubricating means 105 are similar to those described earlier as lubricating means 5. These utilize oil lift tubes, each designated by the numeral 120, which are attached to connecting rod 119. Various means for connecting or including these oil lift tubes within connecting rod 119 may be utilized. However, it is desirable to minimize the diameter of connecting rod 119 so as to minimize the volume which occurs within crankshaft opening 170. Oil is carried to the connecting rod 119 from a source of oil (not shown) through crankshaft 151 and along connecting rod bearing 117. From connecting rod bearing 117, the oil flows through the lower oil port 122 in connecting rod 119 and up through the lift tube 120. The oil lift tube 120 would have a one-way valve at its lower port 122, and will be described in detail later.

In the embodiment shown in FIGS. 11–16, the connecting rod 119 is attached to piston 130 by means of a wrist pin 114 which is supported by bearing 125 located in opening **125*a* of the connecting rod 119. The wrist pin 114 extends through an opening 114*a* in piston 130 to interconnect the connecting rod 119 to the piston. In lubricating system 105, the oil passes out of lift tubes 120 through an upper oil port 124 to the area surrounding the wrist pin. The oil then passes through a hole in the wrist pin to an exterior channel within the wrist pin. From this channel the oil flows through various channels and passageways which communicate to the exterior of the piston. Such passageways were described in apparatus 1** of this patent application.

To propel the oil from the lower oil channel 122 to the upper oil channel 124 in connecting rod 119, it may be necessary to utilize cascade riffles 121 positioned in the lift tube. It is the purpose of riffles 121 to sequentially splash the oil up the interior surface of lift tube 120 by cascading action as the connecting rod 119 continually reciprocates. In this way, an effective lubricating means is provided for a crankcase scavenged internal combustion engine which utilizes a crankcase as a compression chamber for precompressing the combustion gas.

Figure 12:
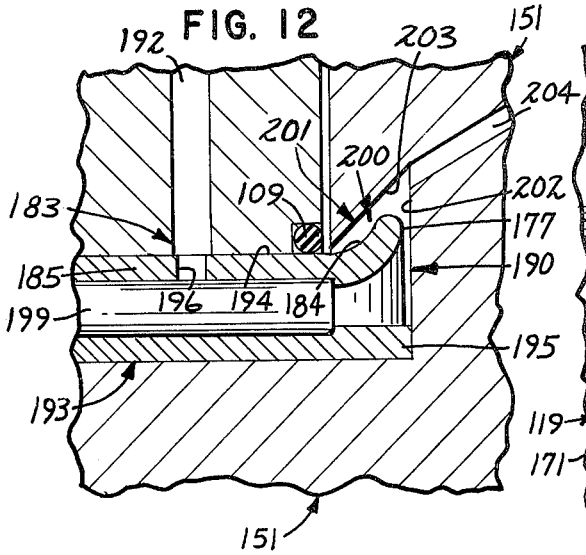
FIG. 12 is a detailed cross-sectional view of a portion of the engine shown in FIG. 11, showing a portion of the main bearing and the oil distribution means.

In the preferred alternative embodiment the oil which is propelled through lubricating means 105 is provided by oil distribution means 190. Details of oil distribution means 190 are depicted in FIGS. 11 and 12. Oil distribution means 190 are intended to move, by centrifugal force, oil from channel means 183 into the main bearing 193 which supports the crankshaft 151, out of the main bearing and into directional cavity means 200. From the directional cavity means 200, the oil is moved through bearing 117 which connects the connecting rod 119 to connecting rod journal 175. From here the oil moves through the bearing opening 205 within bearing 117 and into lower oil port 122 of the connecting rod.

To describe the oil distribution means 190 in detail, reference is made to FIGS. 11 and 12. Oil is supplied from a source (not shown) through an oil supply line 191. From here the oil passes through a first oil channel 192, then through an outer race opening 196 in the outer race 194 of the main bearing 193. The oil then circulates within the bearing, such as around the bearing rollers 199 shown in FIG. 12. Other types of bearings besides a roller bearing may also be utilized where appropriate. The movement of the bearing then forces the oil outwardly toward the end of the bearing. As is shown in FIG. 12, the outer race of the bearing contains a central portion 185 which is essentially flat and straight and an adjoining end portion 184. In this embodiment, end portion 184 curves outwardly away from the main bearing at an angle which is generally parallel an inclined surface 203 which will be described in detail later.

At the end of the main bearing 193 are directional cavity means 200. Directional cavity means 200 comprise an opening 201 which is formed within the sides of crankshaft 151. Opening 201 is formed from a side surface 202 which adjoins an inclined surface 203. Inclined surface 203 is oblique to side surface 202 and forms an acute angle that in turn forms an annular oil trench 177. At the point where inclined surface 203 and side surface 202 meet, a communicating channel 204 communicates with opening 201 and extends through crankshaft 151 to the exterior of connecting rod journal 175. At this point, communicating channel 204 communicates through a bearing opening 205 in bearing 117. This in turn communicates with lower oil port 122 of connecting rod 119. Oil is then free to flow through connecting rod 119 in the manner described earlier utilizing the oil lift tube 120.

To reduce the need for strong oil pumping capacity, or in certain instances any oil pump requirement at all, oil distribution means 190 utilize centrifugal force to move the oil. Referring to FIG. 12, oil is fed from a source (not shown) through first oil channel 192 through outer race opening 196 to the interior of main bearing 193. Bearing motion then moves the oil outwardly towards the ends of the bearing race 194. Here the oil flows along the contoured end portion 184 of the outer race 194. Because the end of end portion 184 is spaced apart from side surface 202, the oil flows past the end of outer race 194 into opening 201 formed by cavity means 200. Because of the inclined surface 203 forming oil trench 177, the oil is directed outwardly and laterally toward communicating channel 204 by rotational movement of the crankshaft. Because communicating channel 204 is inclined outwardly and laterally, the oil is forced by centrifugal force along communicating channel 204 to bearing opening 205. It is then forced by the centrifugal force into lower oil port 122 and through one-way valve 110. The oil is then distributed through connecting rod 119 by the oil lift tubes 120 and other oil means described earlier. For purposes of description, numeral 197 is described in the drawings to identify the centerline of main bearing 193. For purposes of reference, the end portion 184 of outer race 194 is flared outwardly at an oblique angle to centerline 197.

Other aspects of the operation of the preferred alternative embodiment are similar to those described in the description of the preferred embodiment invention for apparatus 1. In the preferred alternative embodiment, apparatus 101 is directed specifically at a two cycle engine, with the oil distribution means 190 being applicable to a two cycle, a four cycle or other types of engines.

What is claimed is:

1. Improved two cycle internal combustion engine apparatus for driving a power shaft, comprising:

(a) a cylinder with a combustion chamber which has controlled gas intake and exhaust means;

(b) a crankcase positioned adjacent said cylinder and enclosing a crankcase chamber which has a generally cylindrical shape, said crankcase and said cylinder being interconnected to form a generally sealed compression chamber for precompressing combustion air for use in the engine;

(c) a crankshaft mounted in said crankcase for rotation, said crankshaft being connectable to a power shaft and having an exterior surface contour which essentially matches the contour of said crankcase chamber interior surface to reduce the unoccupied volume of said crankcase chamber;

(d) a piston slidably and sealably mounted within said cylinder for reciprocal movement, said piston having a top and bottom and serving as a moving barrier between said cylinder combustion chamber and said crankcase chamber in selected positions, said piston creating an above atmospheric pressure in said crankcase chamber on at least a portion of its downstroke and a below atmospheric pressure on at least a portion of its up-stroke;

(e) a connecting rod interconnecting said piston and said crankshaft for transmitting the reciprocal movement of said piston to a rotary movement of the crankshaft;

(f) said crankcase chamber containing a one-way intake valve positioned between said crankcase chamber and a source of combustion air, said crankcase intake valve openable automatically when the pressure in said crankcase chamber is generally below atmospheric pressure and closable automatically when said pressure is at or above atmospheric pressure;

(g) ignition means for selectively igniting a fuel mixture which may be present in said cylinder combustion chamber;

(h) piston lubrication means for carrying lubricating oil from an oil source through said connecting rod to the periphery of said piston, said piston lubrication means comprising:

(i) oil distribution means for distributing lubricating oil from an oil source to said connecting rod at the point where said connecting rod connects with the crankshaft;

(ii) said connecting rod containing at least one oil lift tube communicating between said oil distribution means and said piston, said lift tube defined in part by an interior surface and including a plurality of riffles positioned along the interior surface of said lift tube to cascade the oil upwardly through said lift tube in response to cyclic motion of said connecting rod, each of said riffles only partially spanning the distance between opposite portions of said interior surface to provide room for the moving oil to cascade past successive riffles from one to another;

(iii) said piston containing a plurality of passageways communicating between said piston rod lift tube and the exterior surface of said piston for carrying oil therethrough to lubricate said piston surface; and (iv) a one-way valve positioned in said oil lift tube said valve opening and closing in response to movement of said piston rod to meter the flow of oil from said distribution means to said lift tube while preventing the back flow of oil from said lift tube through said one-way valve; and (i) said controlled gas intake means including:

(i) at least one gas passageway in said cylinder for conducting combustion gas therethrough to said combustion chamber; and (ii) at least one gas port in said piston communicating with said crankcase chamber, said gas passageway and said gas port being in mutual communication intermittently in response to the movement of said piston to provide cyclic intake of combustion gas into said combustion chamber from said crankcase chamber.

2. The two cycle engine apparatus of claim 1 wherein said oil distribution means include:

(a) a main bearing operably supporting said crankshaft;

(b) channel means communicating between an oil source and said main bearing to channel lubricating oil to said main bearing; and (c) said crankshaft containing directional cavity means to forceably direct lubricating oil from said main bearing to said connecting rod oil lift tube by centrifugal force in response to rotational movement of said crankshaft.

3. Improved two cycle internal combustion engine apparatus for driving a power shaft, comprising:

(a) a cylinder with a combustion chamber which has controlled gas intake and exhaust means;

(b) a crankcase positioned adjacent said cylinder and enclosing a crankcase chamber which has a generally cylindrical shape, said crankcase and said cylinder being interconnected to form a generally sealed compression chamber for precompressing combustion air for use in the engine;

(c) a crankshaft mounted in said crankcase for rotation, said crankshaft being connectable to a power shaft and having an exterior surface contour which essentially matches the contour of said crankcase chamber interior surface to reduce the unoccupied volume of said crankcase;

(d) a piston slidably and generally sealably mounted within said cylinder for reciprocal movement, said piston having a top and bottom and serving as a moving barrier between said cylinder combustion chamber and said crankcase chamber, said piston creating an above atmospheric pressure in said crankcase chamber on at least a portion of its down-stroke and a below atmospheric pressure on at least a portion of its up-stroke;

(e) a connecting rod interconnecting said piston and said crankshaft for transmitting the reciprocal movement of said piston to a rotary movement of the crankshaft;

(f) at least one volume take-up member fixedly positioned within said cylinder, said volume take-up member being sized and positioned to occupy an open indentation which is present in the bottom of said piston, said take-up member thereby reducing the unoccupied volume of said cylinder when said piston has moved through its down stroke to increase compression therebeneath;

(g) said crankcase chamber containing a one-way intake valve positioned between said crankcase chamber and a source of combustion air, said crankcase intake valve openable automatically when the pressure in said crankcase chamber is generally below atmospheric pressure and closable automatically when said pressure is at or above atmospheric pressure;

(h) ignition means for selectively igniting a fuel mixture which is present in said cylinder combustion chamber; and (i) piston lubrication means for carrying lubrication oil from an oil source through said connecting rod to the periphery of said piston, said piston lubrication means comprising:

(i) oil distribution means for distributing lubricating oil from an oil source to said connecting rod at the point where said connecting rod connects with the crankshaft;

(ii) said connecting rod containing at least one oil lift tube communicating between said oil distribution means and said piston, said lift tube defined in part by an interior surface and including a plurality of riffles positioned along the interior surface of said lift tube to cascade the oil upwardly through said lift tube in response to cyclic motion of said connecting rod, each of said riffles only partially spanning the distance between opposite portions of said interior surface to provide room for the moving oil to cascade past successive riffles from one to another;

(iii) said piston containing a plurality of passageways communicating between said piston rod lift rube and the exterior surface of said piston for carrying oil therethrough to lubricate said piston surface;

(iv) a one-way valve positioned in said oil lift tube, said valve opening and closing in response to movement of said piston rod to meter the flow of oil from said distribution means to said lift tube while preventing the back flow of oil from said lift tube through said one-way valve; and (j) said controlled gas intake means including:

(i) at least one gas passageway in said cylinder for conducting combustion gas therethrough to said combustion chamber; and (ii) at least one gas port in said piston communicating with said crankcase chamber, said gas passageway and said gas port being in mutual communication intermittently in response to the movement of said piston to provide cyclic intake of combustion gas into said combustion chamber from said crankcase chamber.

4. The two cycle engine apparatus of claim 3 wherein said oil distribution means include:

(a) a main bearing operably supporting said crankshaft;

(b) channel means communicating between an oil source and said bearing to channel lubricating oil to said bearing; and (c) said crankshaft containing directional cavity means to forceably direct lubricating oil from said main bearing to said connecting rod oil lift tube by centrifugal force in response to rotational movement of said crankshaft.

5. The two cycle engine apparatus of claim 4 wherein said directional cavity means include:

(a) said main bearing being defined in part by a main bearing centerline;

(b) said main bearing having an outer race, said outer race having a central portion connected to an end portion, said central portion extending generally parallel to said bearing centerline;

(c) said crankshaft containing a generally annular opening defined in part by a side surface which is generally perpendicular to the bearing centerline, and an inclined surface which is generally oblique to said side surface, said side surface and inclined surface forming an annular oil trench; and (d) a communicating channel communicating between said oil trench and said connecting rod to allow lubricating oil to flow from said main bearing to said oil trench, and thence through said communicating channel by centrifugal force.

6. An improved internal combustion engine of the type having a movable piston within a cylinder, wherein the improvement comprising:

(a) a crankcase with a crankshaft mounted therein for rotational movement, said crankshaft being connectable to a power shaft, said crankshaft further having an enlarged boss which defines at least one outwardly facing end surface;

(b) a connecting rod interconnecting said crankshaft with the engine piston for transmitting the reciprocal movement of the piston to a rotary movement of the crankshaft;

(c) a main bearing located adjacent to said enlarged boss for operably supporting said crankshaft, said main bearing having one end generally abutting said end surface;

(d) channel means communicating between an oil source and said main bearing to channel lubricating oil to said main bearing, said main bearing being so configured such that the lubricating oil is directed by the bearing to said one end of said main bearing;

(e) said crankshaft containing directional cavity means in said end surface, said directional cavity means being in constant fluidic communication with said one end of said main bearing to receive the lubricating oil therefrom, said directional cavity means being configured to forceably direct lubricating oil from said main bearing to said connecting rod by centrifugal force in response to rotational movement of said crankshaft.

7. The improved internal combustion engine of claim 6 wherein said main bearing is defined in part by a main bearing centerline and said directional cavity means include:

(a) said main bearing having an outer race, said outer race having a central portion connected to an end portion, said central portion extending generally parallel to said bearing centerline;

(b) said crankshaft containing a generally annular opening located in said end surface, said annular opening defined in part by a side surface which is generally perpendicular to the bearing centerline, and an inclined surface which is generally oblique to said side surface, said side surface and inclined surface forming an annular oil trench in said end surface; and (c) a communicating channel communicating between said oil trench and said connecting rod to allow lubricating oil to flow from said main bearing, to said oil trench and thence through said communicating channel by centrifugal force.

8. The improved internal combustion engine of claim 7 wherein said bearing race end portion is oblique to the bearing centerline with the end portion being generally parallel to said opening inclined surface, with the race end portion being spaced apart from said side surface to provide an area through which lubricating oil may flow.

9. The two cycle engine apparatus of claim 2 wherein said directional cavity means include:

(a) said main bearing being defined in part by a main bearing centerline;

(b) said main bearing having an outer race, said outer race having a central portion connected to an end portion, said central portion extending generally parallel to said bearing centerline;

(c) said crankshaft containing a generally annular opening defined in part by a side surface which is generally perpendicular to the bearing centerline, and an inclined surface which is generally oblique to said surface, said side surface and inclined surface forming an annular oil trench; and (d) a communicating channel communicating between said oil trench and said connecting rod to allow lubricating oil to flow from said main bearing, to said oil trench, and thence through said communicating channel by centrifugal force.

10. Improved two cycle internal combustion engine apparatus for driving a power shaft, comprising:

(a) a cylinder with a combustion chamber which has controlled gas intake and exhaust means;

(b) a crankcase positioned adjacent said cylinder and enclosing a crankcase chamber which has a generally cylindrical shape, said crankcase and said cylinder being interconnected to form a generally sealed compression chamber for precompressing combustion air for use in the engine;

(c) a crankshaft mounted in said crankcase for rotation, said crankshaft being connectable to a power shaft and having an exterior surface contour which essentially matches the contour of said crankcase chamber interior surface to reduce the unoccupied volume of said crankcase;

(d) a piston slidably and generally sealably mounted within said cylinder for reciprocal movement, said piston having a top and bottom and serving as a moving barrier between said cylinder combustion chamber and said crankcase chamber, said piston creating an above atmospheric pressure in said crankcase chamber on at least a portion of its down-stroke and a below atmospheric pressure on at least a portion of its up-stroke;

(e) a connecting rod interconnecting said piston and said crankshaft for transmitting the reciprocal movement of said piston to a rotary movement of the crankshaft;

(f) at least one volume take-up member fixedly positioned within said cylinder, said volume take-up member being sized and positioned to occupy an open indentation which is present in the bottom of said piston, said take-up member thereby reducing the unoccupied volume of said cylinder when said piston has moved through its down stroke to increase compression therebeneath;

(g) said crankcase chamber containing a one-way intake valve positioned between said crankcase chamber and a source of combustion air, said crankcase intake valve openable automatically when the pressure in said crankcase chamber is generally below atmospheric pressure and closable automatically when said pressure is at or above atmospheric pressure;

(h) piston lubrication means for carrying lubrication oil from an oil source through said connecting rod to the periphery of said piston, said piston lubrication means comprising:

(i) oil distribution means for distributing lubricating oil from an oil source to said connecting rod at the point where said connecting rod connects with the crankshaft;

(ii) said connecting rod containing at least one oil lift tube communicating between said oil distribution means and said piston, said lift tube serving to cascade the oil upwardly in response to cyclic motion of said connecting rod; and (iii) said piston containing a plurality of passageways communicating between said piston rod lift tube and the exterior surface of said piston for carrying oil therethrough to lubricate said piston surface.

(i) said controlled gas intake means including:

(i) at least one gas passageway in said cylinder for conducting combustion gas therethrough to said combustion chamber; and (ii) at least one gas port in said piston communicating with said crankcase chamber, said gas passageway and said gas port being in mutual communication intermittently in response to the movement of said piston to provide cyclic intake of combustion gas into said combustion chamber from said crankcase chamber; and (j) said oil distribution means including:

(i) a main bearing operably supporting said crankshaft;

(ii) channel means communicating between an oil source and said bearing to channel lubricating oil to said bearing; and (iii) said crankshaft containing directional cavity means to forceably direct lubricating oil from said main bearing to said connecting rod oil lift tube by centrifugal force in response to rotational movement of said crankshaft.

* * * * *

UNITED STATES PATENT AND TRADEMARK OFFICE

CERTIFICATE OF CORRECTION

PATENT NO. : 4,088,097

DATED : May 9, 1978

INVENTOR(S) : Harold Litz

It is certified that error appears in the above-identified patent and that said Letters Patent are hereby corrected as shown below:

In column 1, line 59 for "in" read --is--.

In column 3, line 12 for "occurrs" read --occurs--.

In column 4, line 42 for "cylinderical" read --cylindrical--.

In column 8, line 47 for "preferrable" read --preferable--.

In column 9, line 9 for "The holes 12a" read --The holes 12a are--.

In column 10, line 31 for "encludes" read --includes--.

In column 10, line 60 for "reciproating" read --reciprocating--.

In column 12, line 8 for "is" read --in--.

In column 12, line 17 for "crankcase chambers" read --crankcase chambers 186--.

In column 13, line 23 for "oil," read --oil--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*